US012270261B2

(12) United States Patent
Fitzhugh et al.

(10) Patent No.: US 12,270,261 B2
(45) Date of Patent: Apr. 8, 2025

(54) WIRELINE SAVER TOOL

(71) Applicant: Ferro Supply LLC, Godley, TX (US)

(72) Inventors: Bryan Samuel Fitzhugh, Colleyville, TX (US); Carter Oswalt, Midland, TX (US); Timothy Wayne Raley, Hickory, NC (US)

(73) Assignee: Ferro Supply LLC, Godley, TX (US)

( * ) Notice: Subject to any disclaimer, the term of this patent is extended or adjusted under 35 U.S.C. 154(b) by 0 days.

(21) Appl. No.: 18/189,232

(22) Filed: Mar. 24, 2023

(65) Prior Publication Data

US 2023/0304364 A1 Sep. 28, 2023

Related U.S. Application Data

(60) Provisional application No. 63/323,326, filed on Mar. 24, 2022.

(51) Int. Cl.
*E21B 17/10* (2006.01)

(52) U.S. Cl.
CPC ..... *E21B 17/1078* (2013.01)

(58) Field of Classification Search
CPC ..... E21B 17/1078; E21B 19/10; E21B 17/023
See application file for complete search history.

(56) References Cited

U.S. PATENT DOCUMENTS 3,335,469 A * 8/1967 Shand ..... E06C 7/186 24/115 L
4,299,280 A * 11/1981 Greer ..... E21B 33/072 166/113
4,498,563 A * 2/1985 Trahan ..... E21B 19/22 188/188
4,577,687 A * 3/1986 Lanmon, II ..... E21B 33/072 166/243
4,844,210 A * 7/1989 Wong ..... E21B 19/12 188/65.1
7,934,548 B2 * 5/2011 Doud ..... E21B 41/0021 166/250.01
7,997,334 B2 * 8/2011 McCorry ..... E21B 33/072 166/88.1
11,162,318 B2 * 11/2021 McDaniel ..... E21B 33/072
11,536,100 B2 * 12/2022 Krishnasamy ..... E21B 19/10
2002/0066562 A1 * 6/2002 Nice ..... E21B 33/076 166/257

(Continued)

FOREIGN PATENT DOCUMENTS

WO 2015198041 A2 12/2015

OTHER PUBLICATIONS

PCT/US2023/016104 , "International Search Report and Written Opinion", Aug. 11, 2023, 10 pages.

(Continued)

*Primary Examiner* — Steven A MacDonald
(74) *Attorney, Agent, or Firm* — Kilpatrick Townsend & Stockton LLP

(57) ABSTRACT

Wireline saver tool assemblies may be used for oil and gas operations. In some cases, the wireline saver tool assemblies may provide a mechanical catch for a wireline saver tool for minimizing and/or preventing the wireline tool from falling freely from a lubricator in the event of an operator and/or equipment failure. Operator input may not be required to catch and/or prevent falling of the wireline tool.

15 Claims, 9 Drawing Sheets

(56) References Cited

U.S. PATENT DOCUMENTS

| | | | | |
|---|---|---|---|---|
| 2015/0233212 | A1* | 8/2015 | Leggett | E21B 33/072 166/83.1 |
| 2016/0201424 | A1* | 7/2016 | Keller | E21B 33/072 166/75.11 |
| 2021/0079751 | A1* | 3/2021 | McDaniel | E21B 33/0407 |

OTHER PUBLICATIONS

PCT/US2023/016104 , "Invitation to Pay Additional Fees and, Where Applicable, Protest Fee", Jun. 2, 2023, 2 pages.

* cited by examiner

WIRELINE SAVER TOOL

REFERENCE TO RELATED APPLICATION

This application claims the benefit of U.S. Provisional Patent Application No. 63/323,326, filed on Mar. 24, 2022, and entitled WIRELINE SAVER TOOL, the content of which is hereby incorporated by reference in its entirety.

FIELD OF THE INVENTION

This application generally relates to systems and methods for controlling equipment for wells for natural resource exploration and production, and, more particularly, to systems and methods utilizing wirelines.

BACKGROUND

Natural resource production may include many stages and processes for producing finished or usable products from a natural resource, such as but not limited to hydrocarbons. Some natural resources are extracted using one or more wells during an exploration and production stage of natural resource production, during which the one or more wells are established and used for production over the life of the well. Regardless of the particular stage or phase of the well (e.g., well completion stage, drilling stage, production stage, etc.), it may be common to use a wireline system to place and recover wellbore equipment in a well, perform measurements, and other operations or combinations of operations as desired. Such wireline systems include a wireline connected to a wireline tool string, and the wireline may be supported on a crane or boom apparatus and raised and lowered via a spool to raise and lower the equipment into and out of the well. In operations with a plurality of wells, it may be common for an operator to move equipment with the wireline system from one well to another. In such cases, the tool string may be withdrawn from a first well and supported by the wireline at least partially within the lubricator while the crane or other apparatus moves to the next well. Some wireline operations can require the manipulation of the wireline tool string and manipulation of the lubricator to be performed simultaneously. Regardless, during such movement, operator and/or equipment error may cause the wireline tool string to fall out of the bottom of the lubricator, presenting a significant safety hazard to nearby operators.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a wireline saver tool assembly includes means for automatically mechanically engaging a support device of a wireline tool string.

According to some embodiments, a wireline saver tool assembly includes non-hydraulic means for mechanically engaging a support device of a wireline tool string.

According to various embodiments, a wireline saver tool assembly includes a housing and one or more stoppers within the housing, wherein the one or more stoppers are movable within the housing for selectively engaging a support device of a wireline tool string within the housing.

According to some embodiments, a wireline saver tool assembly includes a housing and one or more stoppers within the housing, wherein the one or more stoppers are configured to narrow a travel path for a support device of a wireline tool string within the housing responsive to an activating event.

According to certain embodiments, a wireline saver tool assembly includes a housing defining a central aperture through the housing, the housing including a neck within the central aperture defining a minimum dimension of the central aperture, wherein the neck is within the central aperture between a top end and a bottom end of the housing. The wireline saver tool assembly also includes one or more stoppers within the central aperture and configured to engage a support device of a wireline tool string within the housing at the neck of the housing.

According to various embodiments, a wireline saver tool assembly includes a housing, a first movement limiting feature, and a second movement limiting feature, wherein the first movement limiting feature defines a maximum upward position of a support device of a wireline tool string within the housing, and wherein the second movement feature defines a maximum downward position of the support device within the housing.

According to some embodiments, a wireline saver tool assembly includes a support device couplable to a tool string, the support device including an outer surface and a lip extending outwards from the outer surface. The wireline saver tool assembly also includes a housing and means for mechanically engaging the outer surface and the lip of the support device within the housing.

According to certain embodiments, a wireline saver tool assembly includes a housing, a biasing mechanism, and one or more stoppers within the housing, wherein the biasing mechanism is configured to move the one or more stoppers within the housing and to engage a support device of a wireline tool string within the housing responsive to an activating event.

According to various embodiments, a wireline saver tool assembly includes a housing having a first end and a second end, wherein the first end is couplable to a lubricator, and wherein the second end is configured to receive a support device for a tool string. The wireline tool saver assembly also includes a plug configured to engage the support device within the housing, an upper retaining mechanism positioning the plug within the housing, a biasing member within the housing, and one or more stoppers within the housing. The wireline tool saver assembly further includes an insert within the housing and forming an interface between the biasing member and the one or more stoppers, wherein the plug contacts the insert within the housing and the contact positions the insert within the housing. The wireline tool saver assembly also includes a lower retaining mechanism positioning the one or more stoppers within the housing. In certain embodiments, responsive to an upward force at a predetermined threshold: the upper retaining mechanism fails such that the plug is moved upwards within the housing; upward movement of the plug causes the plug to lose contact with the insert; the lost contact between the plug and the insert allows a downward force from the biasing member on the insert causes the lower retaining mechanism to fail; and the one or more stoppers are moved downwards responsive to the failure of the lower retaining mechanism and the downward force from the biasing member.

Various implementations described herein may include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 2:
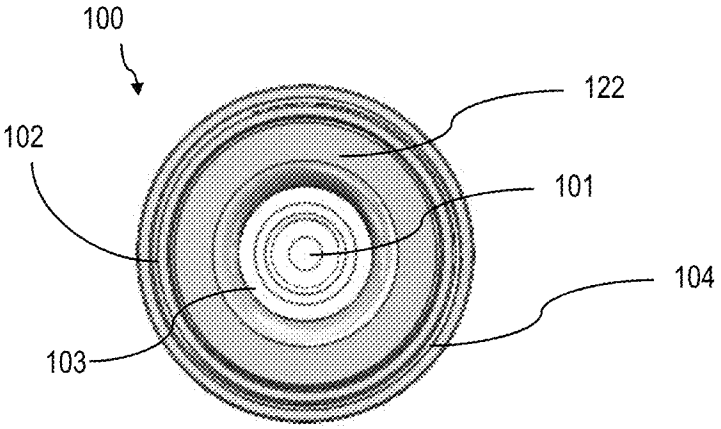
FIG. 2 is a top view of the wireline saver tool of FIG. 1.
Figure 3:
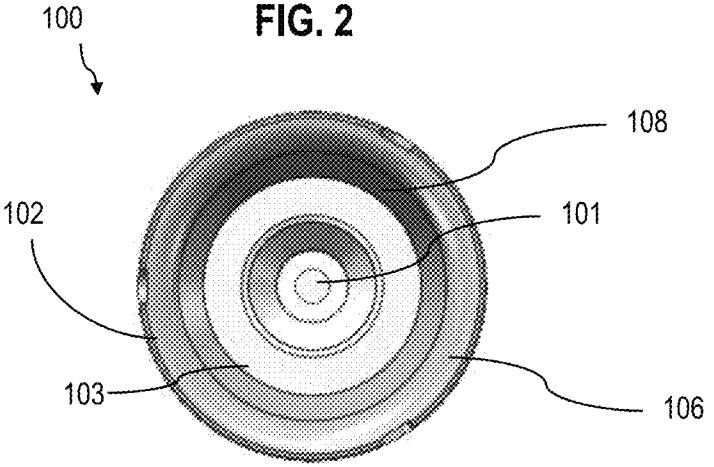
FIG. 3 is a bottom view of the wireline saver tool of FIG. 1.
Figure 1:
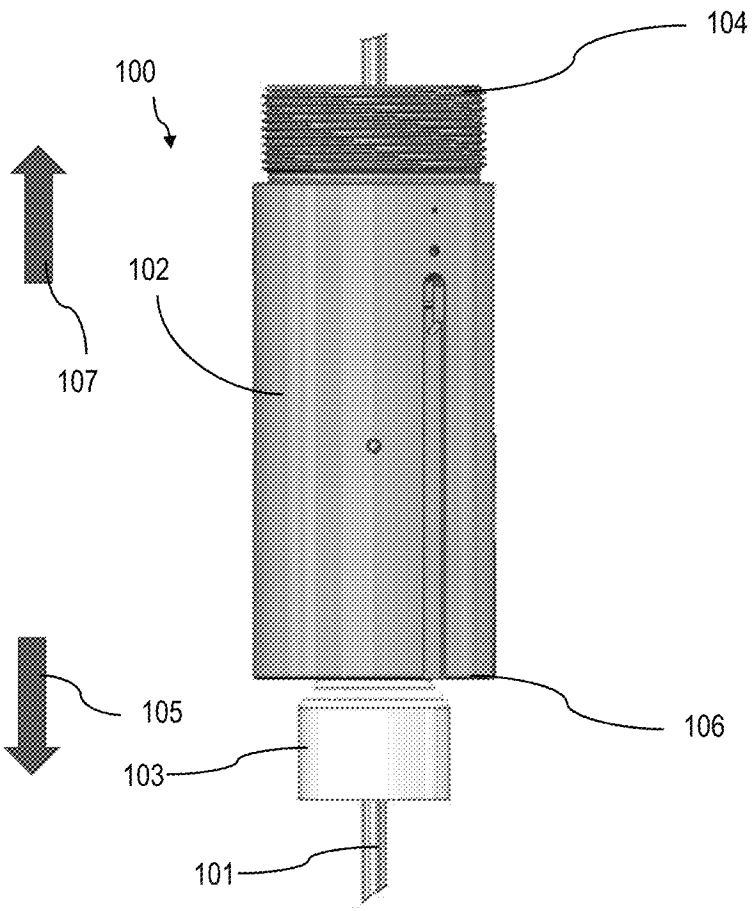
FIG. 1 illustrates a wireline saver tool according to embodiments.

Described herein are wireline saver tools that may be used for oil and gas operations. The wireline saver tools described herein may provide a mechanical catch for a wireline saver tool for minimizing and/or preventing the wireline tool from falling freely from a lubricator in the event of an operator and/or equipment failure. In some embodiments, the wireline saver tool advantageously is a passive catch system for the wireline tool, and operator input is not required to catch and/or prevent falling of the wireline tool. Various other benefits and advantages may be realized with the wireline saver tool described herein, and the aforementioned benefits and advantages should not be considered limiting.

FIGS. 1-7 illustrate a wireline saver tool 100 (herein after "tool 100") according to certain embodiments of the present disclosure.

The tool 100 generally includes a housing 102 having a first (or upper) end 104 and a second (or lower) end 106. A central aperture 108 may extend from the first end 104 to the second end. In certain embodiments, the first end 104 may be coupled to a lubricator; however, in other embodiments, the housing 102 may be coupled to other equipment as desired. As used herein, the tool 100 coupled to the lubricator or other equipment includes the tool 100 being removably coupled to the lubricator or other equipment via engagement mechanisms, permanently coupled to the lubricator or other equipment, or natively formed with the lubricator or other equipment. Engagement mechanisms facilitating removable coupling between the tool 100 and the lubricator or other equipment may include features such as but not limited to threading, mechanical fasteners, friction fit features, clips, clasps, hooks, pins, combinations thereof, and/or other features or mechanisms allowing the tool 100 to be attached to or detached from the lubricator or other equipment as desired. In other embodiments, the tool 100 may be permanently coupled to the lubricator or other equipment using various techniques or mechanisms as desired, such as but not limited to welding, soldering, brazing, adhesives, combinations thereof, and/or other techniques or mechanisms as desired.

Figure 5:
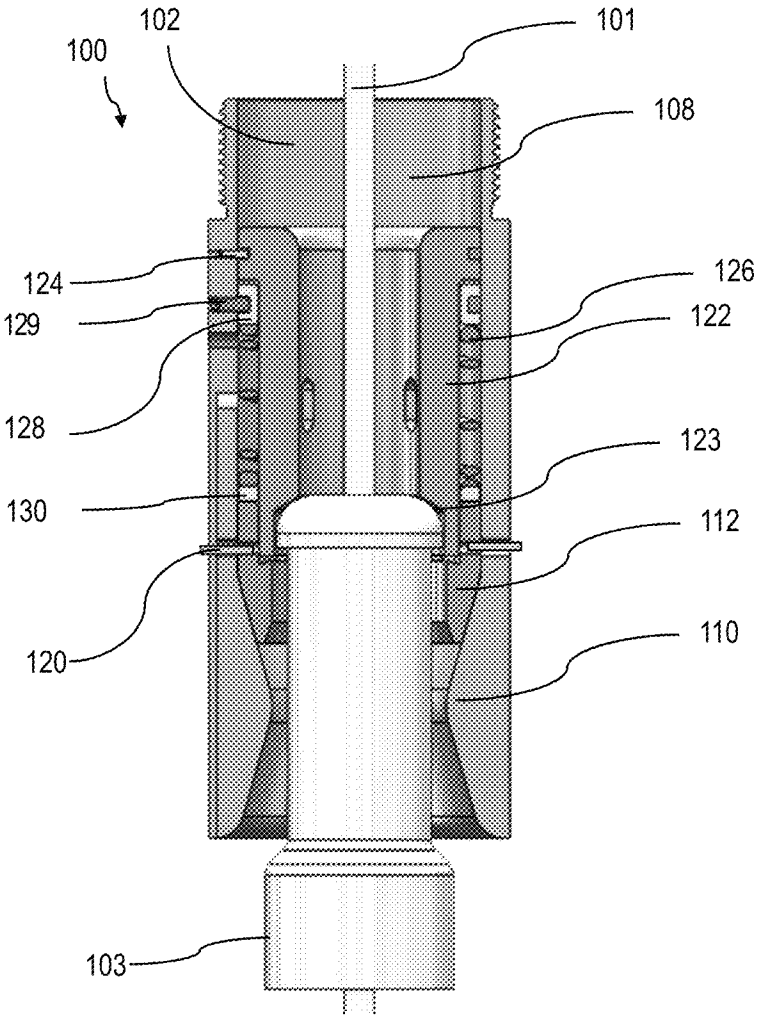
FIG. 5 is a sectional view of the wireline saver tool of FIG. 1 in a normal (or base) configuration.

As illustrated in FIG. 5, for example, and discussed in detail below, a portion of a wireline 101 may extend through the central aperture 108, and a support device 103 attached to the wireline 101 and couplable to a tool string (not illustrated) may be at least partially received within the central aperture 108. Means for mechanically catching the support device 103 may be provided within the housing 102 for selectively catching and/or minimizing downward movement (represented by arrow 105) of the support device 103. As a non-limiting example, during use of a drill string with the tool 100, the tool string and support device 103 may be subjected to a force causing an initial upward movement (represented by arrow 107) of the support device 103 and drill string within the tool 100 and into/towards the lubricator. The means for mechanically catching the support device 103 may automatically catch the support device 103 responsive to such a force and/or to minimize downward movement 105 of the support device 103 and tool string when the force causing upward movement is no longer present. Advantageously, the tool 100 with the means for catching the support device 103 may be passive/automatically deployed or activated and no operator input is required, thereby providing an improved response time and elimination of potential deployment issues due to operator error and/or active deployment error. As an example, hydraulic and/or pneumatic activation by an operator is not needed to activate the tool 100 to catch the support device 103.

Referring to FIGS. 1-5, the tool 100 is described in greater detail.

As mentioned, the housing 102 defines the central aperture 108. In certain embodiments, the housing 102 includes a neck portion 110 within the housing 102 that defines a minimum diameter (or transverse dimension) of the central aperture 108. Stated differently, the neck portion 110 may define a narrowest portion of a travel path for the support device 103 within the tool 100. The particular shape or profile of the neck portion 110 should not be considered limiting. In various embodiments and discussed in detail below, the neck portion 110 may facilitate catching of the support device 103.

In some embodiments, the means for catching the support device 103 may include one or more stoppers 112 within the housing 102. Additional components may be utilized as discussed in detail below, but it will be appreciated that additional and/or alternative components may be utilized as desired.

Figure 4:
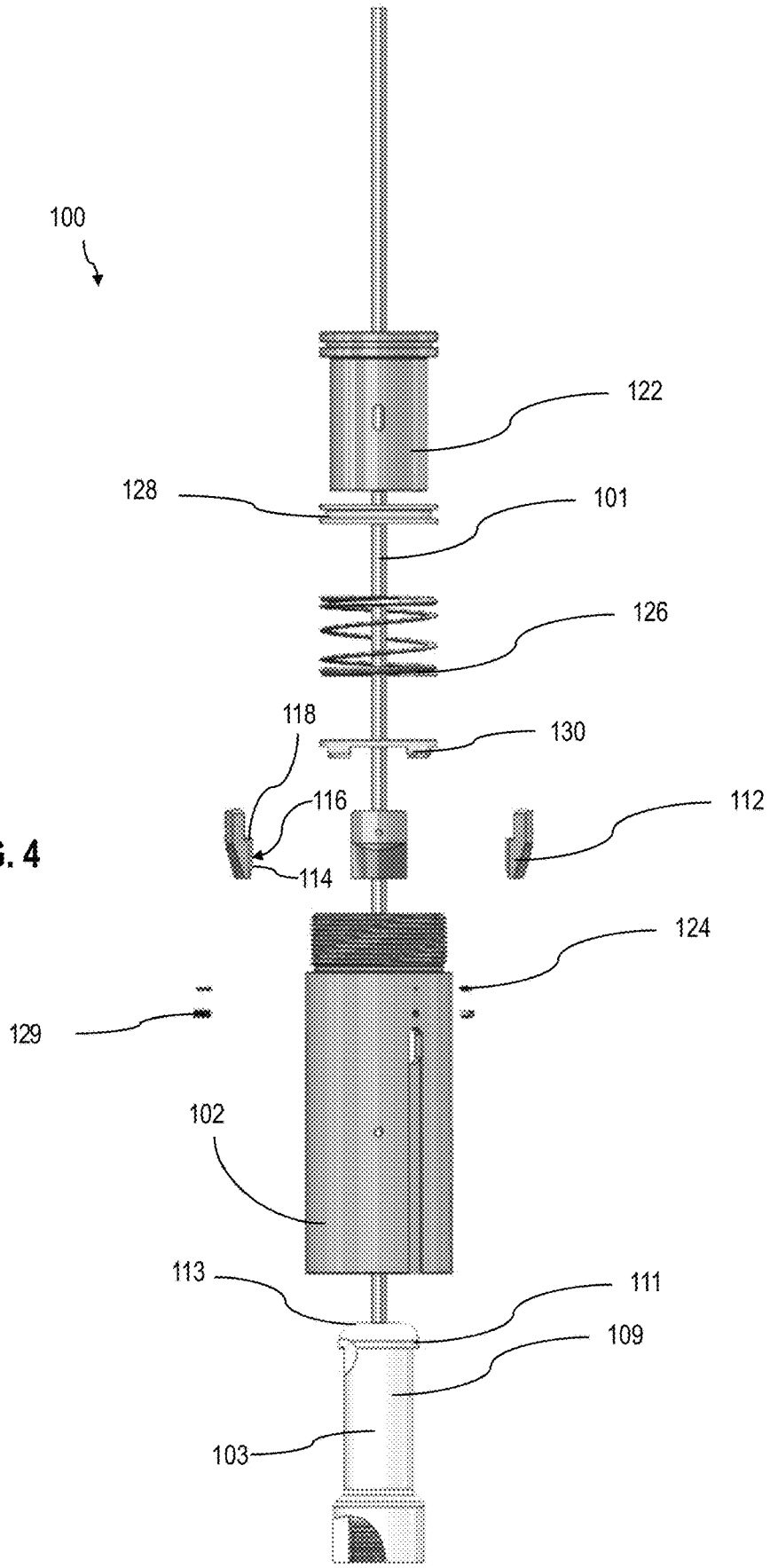
FIG. 4 is an exploded view of the wireline saver tool of FIG. 1.
Figure 8:
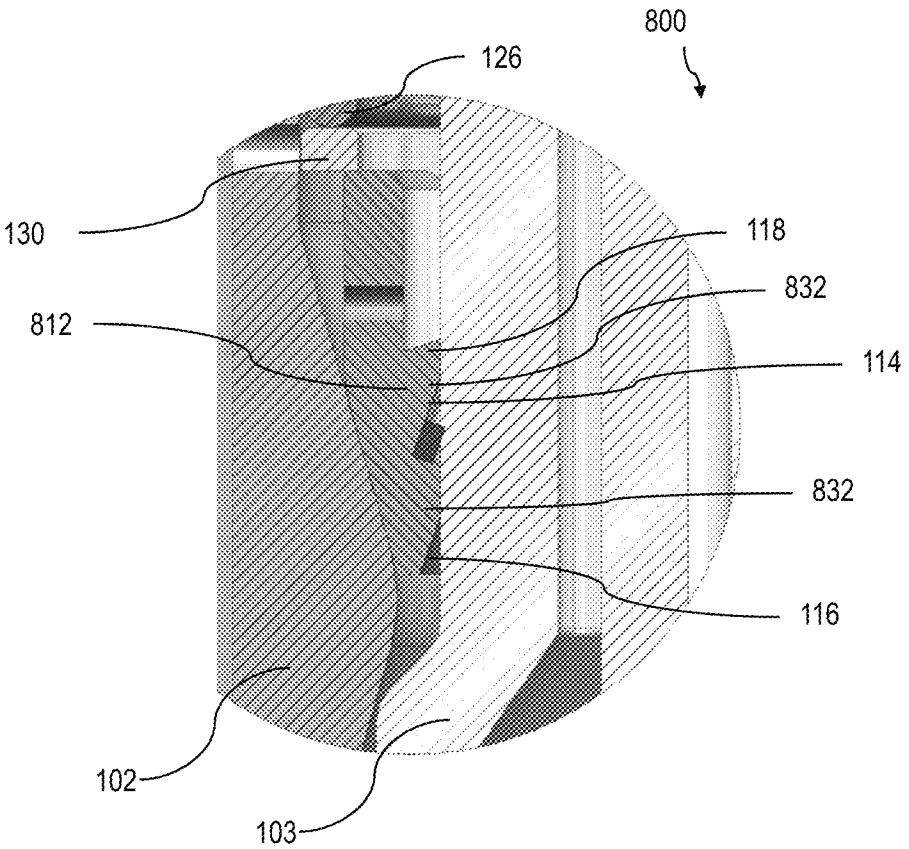
FIG. 8 illustrates a portion of another wireline saver tool according to embodiments.
Figure 11:
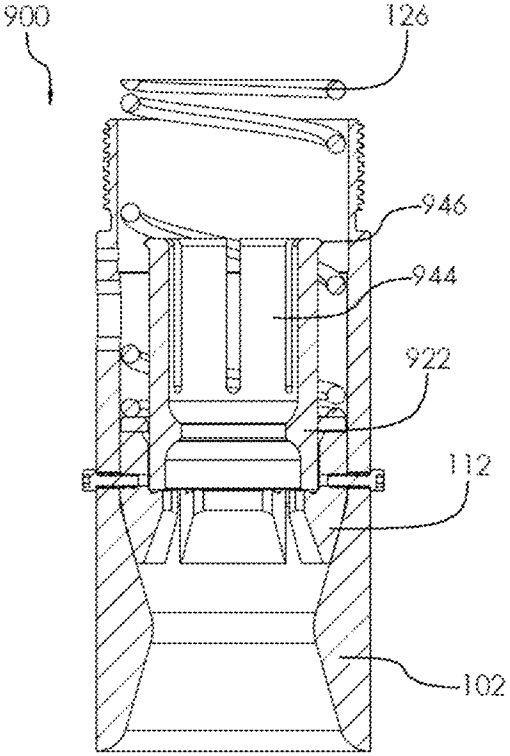
FIG. 11 is a sectional view of a portion of the wireline saver tool of FIG. 9 during assembly.
Figure 10:
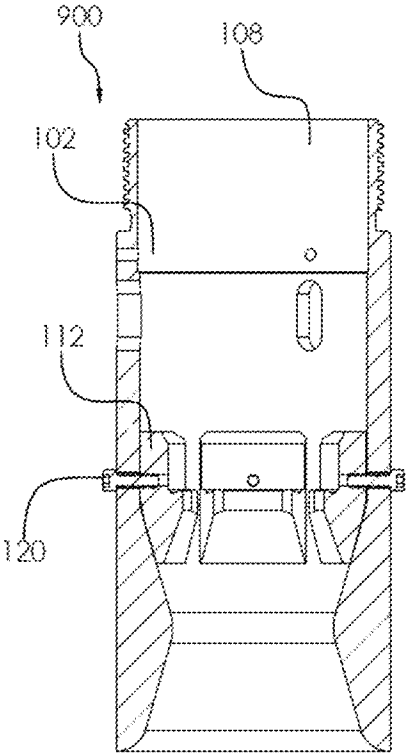
FIG. 10 is a sectional view of a portion of the wireline saver tool of FIG. 9 during assembly.

The stoppers 112 (also referred to as slips) may be various suitable devices or features for engaging the support device 103. Any number of stoppers 112 may be utilized with the tool as desired, and the number of stoppers 112 illustrated should not be considered limiting. The stoppers 112 may be constructed from various materials as desired. As best illustrated in FIG. 4, the stoppers 112 generally include an engagement profile 114 for engaging the support device 103. In some embodiments, the engagement profile 114 includes an engagement surface 116. Optionally, the engagement profile 114 includes an engagement lip 118. In other embodiments, the stoppers 112 may have other engagement profiles 114 as desired. As a non-limiting example, FIG. 8 illustrates a wireline tool saver 800 substantially similar to the tool 100 and with another stopper 812 that is substantially similar to the stopper 112 where the engagement profile 114 includes a plurality of ribs 832.

In various embodiments, the tool 100 includes one or more (lower) retaining mechanisms 120 for retaining the one or more stoppers 112 in a normal or base position as illustrated in FIG. 5. In certain embodiments and as discussed in detail below, the retaining mechanisms 120 may selectively fail and/or otherwise allow the one or more stoppers 112 to move to the deployed position (FIGS. 6 and 7) responsive to an activating event. In one non-limiting example, the retaining mechanisms 120 may be shear pins; however, other suitable devices or mechanisms may be utilized to at least temporarily retain the stoppers 112 in the base position.

In some embodiments, the tool 100 may also include a plug 122 at least partially positioned within the housing 102. As best illustrated in FIG. 5, the plug 122 may interface with the support device 103 within the central aperture 108. In certain embodiments, the plug 122 includes an engagement feature 123 for selectively interfacing the support device 103 and limiting or preventing movement of the support device 103 through the plug 122. In the embodiment illustrate, the engagement feature 123 includes a recess and a reduced inner diameter; however, in other embodiments, other engagement features 123 may be utilized with the plug 122.

In certain embodiments, one or more (upper) retaining mechanisms 124 may retain the plug 122 in its base position as illustrated in FIG. 5. In certain embodiments and as discussed in detail below, the retaining mechanisms 124 may fail and/or otherwise allow for movement of the plug 122 (and the support device 103). In some embodiments, the retaining mechanisms 124 optionally may be configured to allow for movement of the plug 122 and the support device 103 responsive to an upwards force exceeding a predetermined threshold and/or responsive to a change in force applied on the wireline 101 exceeding a predetermined threshold. In such embodiments, the predetermined threshold may correspond. In one non-limiting example, the retaining mechanisms 124 may be shear pins; however, other suitable devices or mechanisms may be utilized to at least temporarily retain the plug 122 in the base position.

A biasing member 126 may be retained within the housing 102 between the stoppers 112 and the upper retaining mechanisms 124. The biasing member 126 may be various suitable devices or mechanisms that are elastically deformable. In the embodiment illustrated, the biasing member 126 is a spring. Optionally, a support 128 may be provided within the central aperture 108. A support retaining mechanism 129, such as but not limited to a pin or other suitable feature, may be used to position the support 128 within the central aperture 108. In some embodiments, an insert 130 may be provided opposite the support 128 and between the biasing member 126 and the stoppers 112. In certain embodiments, in the base position illustrated in FIG. 5, the biasing member 126 may be retained in a compressed state due to the support 128, contact between the insert 130 and the plug 122, and the lower retaining mechanisms 120. In such embodiments, the contact between the plug 122 and the insert 130 may maintain a position of the insert 130 within the central aperture 108, and such contact together with the support from the lower retaining mechanisms 120 may be greater than a downwards force being applied by the biasing member 126 on the insert 130 (and thus on the stoppers 112). As discussed in detail below, responsive to the activating event, the biasing member 126 may move the stoppers 112 downwards to mechanically catch the support device 103.

The support device 103 couplable to the wireline 101 may have various shapes or profiles as desired, and the particular shape or profile should not be considered limiting. Optionally, the support device 103 includes an outer surface 109 and a lip 111 extending outwards from the outer surface 109 (see FIG. 4). In certain embodiments, a transverse dimension of the support device 103 at an end 113 is less than the transverse dimension of the central aperture 108 at the neck 110 such that the support device 103 may be at least partially inserted into the tool 100 through the second end 106.

As mentioned, FIG. 5 illustrates the tool 100 in a normal or base configuration. As illustrated in FIG. 5, in the base configuration, the biasing member 126 may be retained in its compressed state, the support device 103 is at least partially positioned within the central aperture 108, and the plug 122 is engaged with the support device 103 within the central aperture 108. In certain embodiments, the stoppers 112 are retained within the central aperture (e.g., via the retaining mechanisms 120) such that the engagement profile 114 (e.g., engagement surface 116 and/or engagement lip 118) are lower (e.g., closer to the second end 106) than the lip 111 of the support device 103. In certain embodiments, such positioning of the stoppers 112 relative to the support device 103 may further facilitate engagement between the stoppers 112 and the support device 103 and/or may improve deployment of the stoppers 112.

Figure 6:
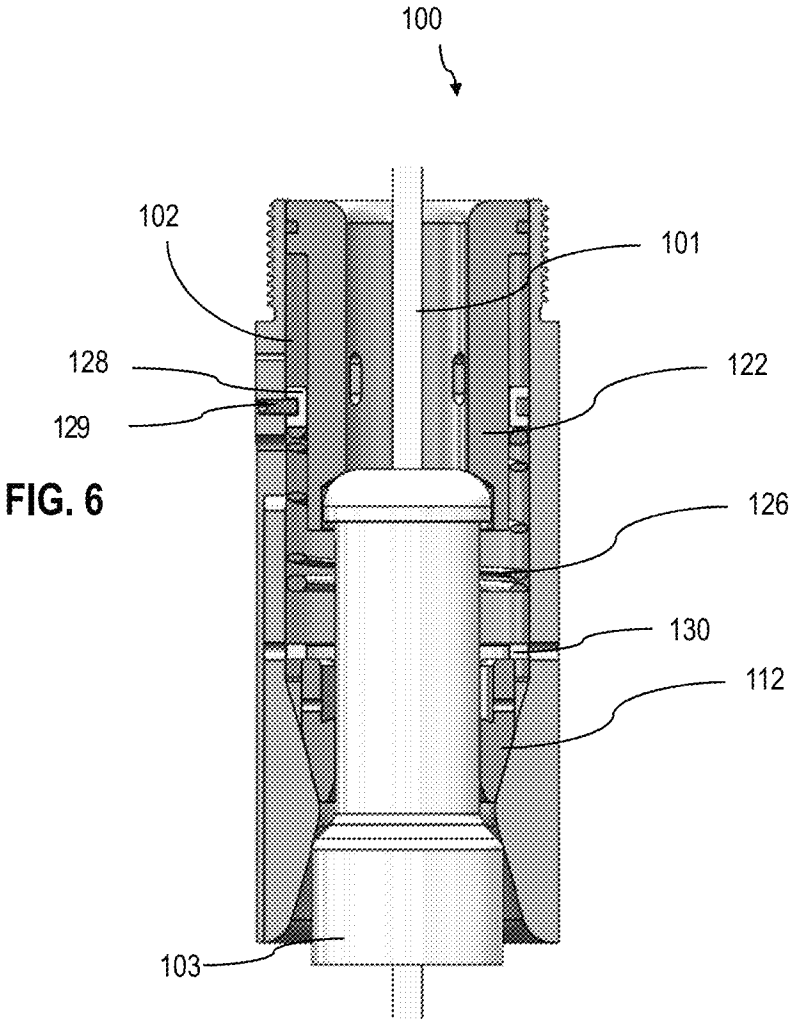
FIG. 6 is a sectional view of the wireline saver tool of FIG. 1 in an operating position responsive to an upwards force compared to FIG. 5.

FIG. 6 illustrates the tool 100 in an intermediate configuration responsive to an activating event. In certain embodiments, the activating event may be, but does not have to be, an upward force being applied on the wireline 101 (and thus support device 103). In various embodiments, such a force may be greater than a predetermined threshold and/or may be a change in force greater than some predetermined threshold. In one non-limiting example, an activating event may be caused by operator error and/or equipment error such that the manipulation of the wireline tool string and the manipulation of the lubricator (connected to the tool 100) are desynchronized.

As illustrated in FIG. 6, such an activating event applies a force on the upper retaining mechanisms 124 sufficient to cause the upper retaining mechanisms 124 to fail and/or otherwise movement of the plug 122 and the support device 103 upwards (towards the first end 104) within the central aperture 108. As illustrated in FIG. 6, the neck portion 110 optionally may engage the support device 103 in the intermediate configuration and serve as a limit on the upward movement of the support device 103.

In various embodiments, the upward movement of the plug 122 caused by the activating event in turn may cause the plug 122 to no longer contact the insert 130, and the loss of contact with the plug 122 allows for the downward force from the biasing member 126 to overcome the support provided by the lower retaining mechanisms 120. In other words, the biasing member 126 may cause the lower retaining mechanisms 120 to fail and/or otherwise allow movement of the insert 130 and the stoppers 112 such that the stoppers 112 are pushed downwards towards the second end 106 and into their deployed position. As illustrated by comparing FIG. 5 with FIG. 6, in the deployed position, the stoppers 112 may further narrow the travel path for the support device 103, and the stoppers 112 optionally may engage the support device 103. In some optional embodiments, a curvature and/or profile of the neck 110 may facilitate movement of the stoppers 112 from the base position to the deployed position. It is noted that in FIG. 6, the biasing member is incorrectly illustrated as still being compressed-in the intermediate configuration of FIG. 6, the biasing member 126 would maintain contact with the insert 130.

Figure 7:
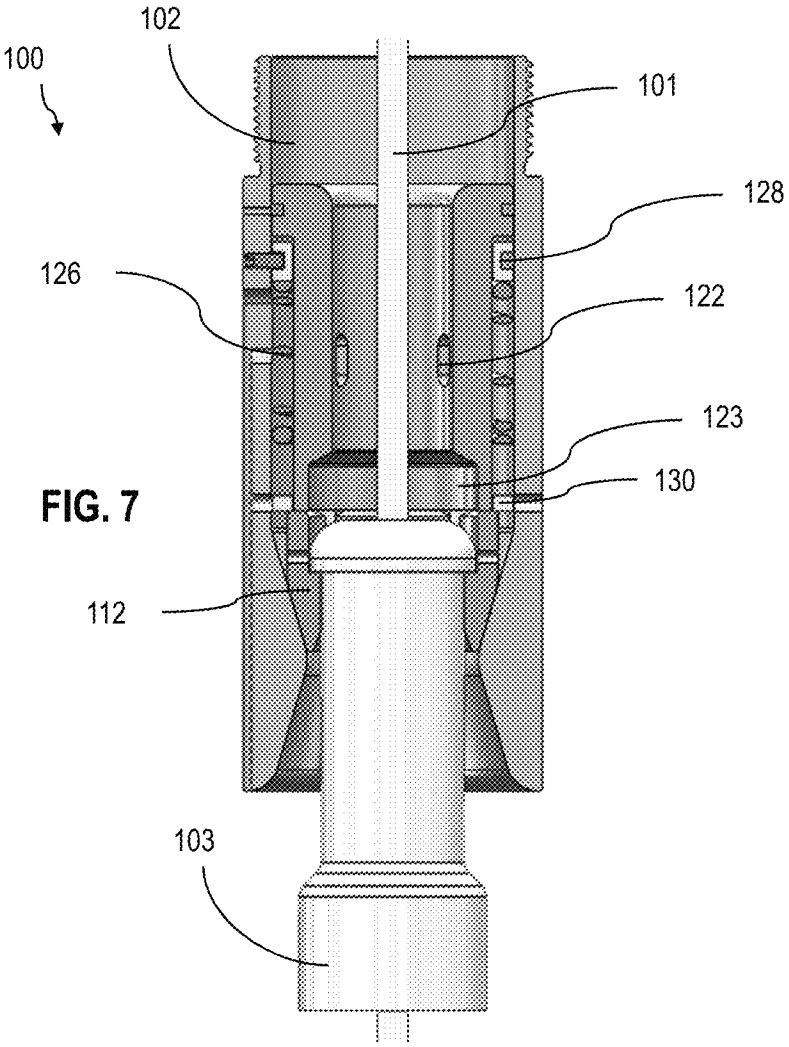
FIG. 7 is a sectional view of the wireline saver tool of FIG. 1 in an operating position in the absence of the upwards force in FIG. 6.

FIG. 7 illustrates the tool 100 in a fully deployed configuration. The tool 100 may be in this configuration once the original activating event causing movement in FIG. 6 has ended and/or an upward force is no longer being applied on the wireline 101. As illustrated in FIG. 7, in this configuration, the support device 103 (and any connected tool string) may fall downwards (e.g., due to gravity). However, the stoppers 112 in the deployed position are able to engage and catch the support device 103 to prevent the support device 103 from falling completely through the second end 106. As illustrated in FIG. 7, in the deployed position, the engagement profile 114 of the stoppers 112 engages the support device 103. In the embodiment illustrated, the stoppers 112 engage both the lip 111 and the outer surface 109; however, as previously mentioned, the stoppers 112 may engage the support device 103 as desired depending on a particular engagement profile 114 utilized. In this manner, the stoppers 112 may server as a limit on the downward movement of the support device 103 and/or a maximum downward position of the support device 103 relative to the tool 100 once the tool 100 is deployed, thereby providing improved safety to an environment in which the wireline 101 is being used.

FIGS. 9-19 illustrate another example of a tool 900 according to embodiments. In certain embodiments, the tool 900 may be used with various support devices as desired. As non-limiting examples, the tool 900 may be used with the support device 103, a support device 903 (see, e.g., FIG. 15) having a reduced diameter portion, and/or other support devices as desired.

The tool 900 is similar to the tool 100 and includes the housing 102 with the central aperture 108, the stoppers 112, the biasing member 126, and the insert 130. Compared to the tool 100, and as discussed in detail below, the tool 900 includes a different plug 922 and a different support 928. As discussed in detail below, the tool 900 omits the retaining mechanisms 124 for the plug. In some embodiments, omitting the retaining mechanisms 124 may reduce the number of components of the tool 900 and facilitate installation and operation of the tool 900; however, in other embodiments, the retaining mechanisms 124 may be utilized.

Figure 9:
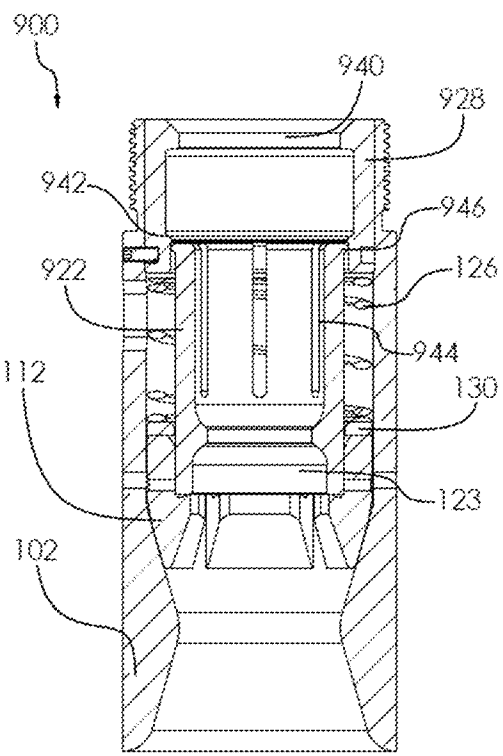
FIG. 9 is a sectional view another wireline saver tool according to embodiments.
Figure 12:
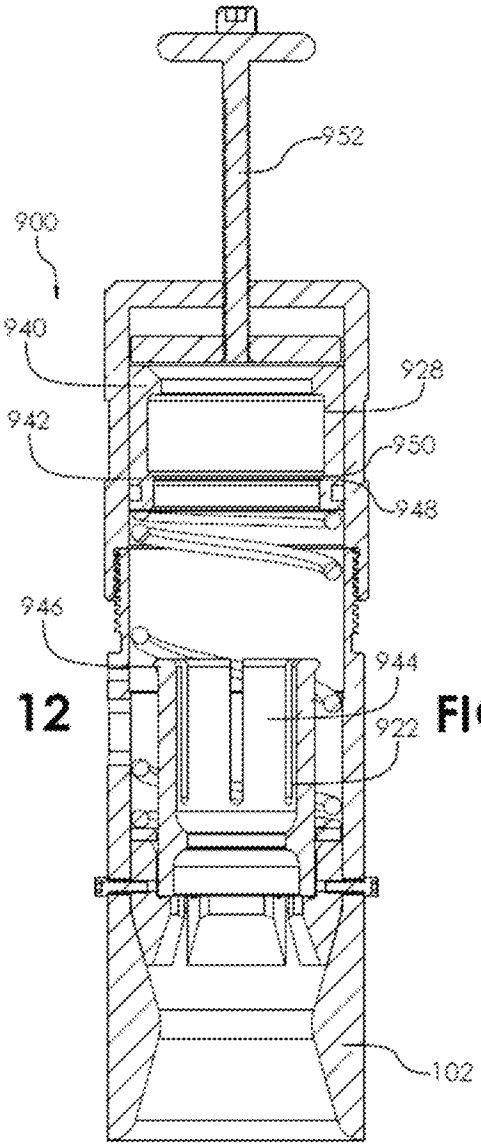
FIG. 12 is a sectional view of a portion of the wireline saver tool of FIG. 9 during assembly.

Referring to FIG. 9, similar to the support 128, the support 928 may be provided within the central aperture 108 and positioned using the support retaining mechanism 129. Compared to the support 128, the support 928 includes an upper ledge 940 and a lower ledge 942. The upper ledge 940 may interface with the plug 922 to limit or prevent movement of the plug 922 through the support 928 (e.g., responsive to an upwards force). In various embodiments, the lower ledge 942 may be engaged by the plug 922 in a normal configuration. In certain embodiments, and as illustrated in FIG. 12, for example, the lower ledge 942 includes a lower surface 948 and an upper surface 950. In some embodiments, in the normal configuration, the plug 922 may engage the lower surface 948 and such that the plug 922 is positioned within the lower ledge 942 and the stoppers 112, and the lower ledge 942 may serve as an upward retaining mechanism for the plug 922.

In some embodiments, a width of the upper ledge 940 (e.g., an extent to which the upper ledge 940 extends inwards) may be the same as or different from a width of the lower ledge 942. In one non-limiting example, the width of the upper ledge 940 may be greater than the width of the lower ledge 942. The upper ledge 940 is spaced apart from the lower ledge 942, thereby providing a clearance for the plug 922 to move responsive to an upwards force. While the ledges 940, 942 are illustrated as continuous, they need not be continuous in other embodiments.

Still referring to FIG. 9, similar to the plug 122, the plug 922 includes the engagement feature 123 for selectively interfacing the support device and limiting or preventing movement of the support device through the plug 922. Compared to the plug 122, the plug 922 includes a plurality of flex members 944, and each flex member 944 includes a lip 946 for selectively engaging the lower ledge 942. In this regard, compared to the plug 122, the plug 922 may be considered a collet, although it need not in other embodiments. In the normal configuration, the lips 946 of the flex members 944 engage the lower surface 948 of the lower ledge 942. In an operating configuration and responsive to receiving an upwards force and the removal of the upwards force, the lips 946 may engage the upper surface 950 to catch the plug 922 within the central aperture 108.

Contact between the plug 922 and the insert 130 may maintain a position of the insert 130 within the central aperture 108, and such contact together with the support from the lower retaining mechanisms 120 may be greater than a downwards force being applied by the biasing member 126 on the insert 130 (and thus on the stoppers 112). As discussed in detail below, responsive to the activating event, the biasing member 126 may move the stoppers 112 downwards to mechanically catch the support device.

Figure 14:
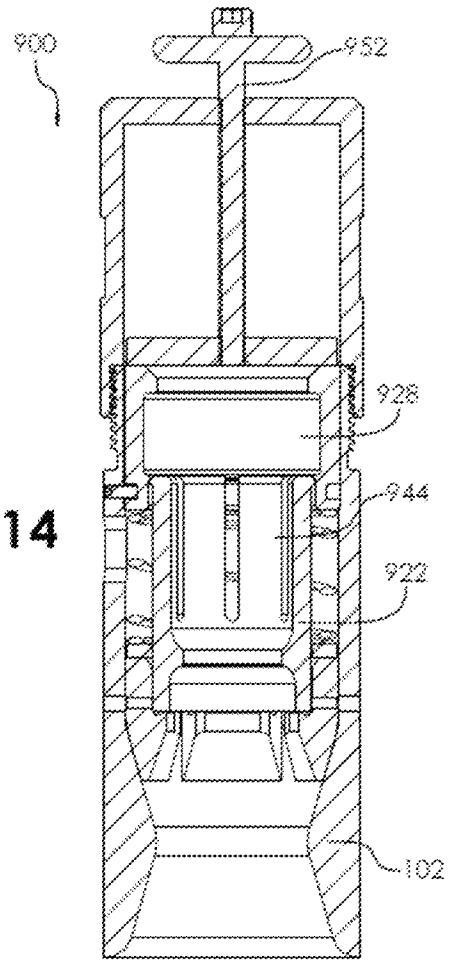
FIG. 14 is a sectional view of a portion of the wireline saver tool of FIG. 9 during assembly.
Figure 13:
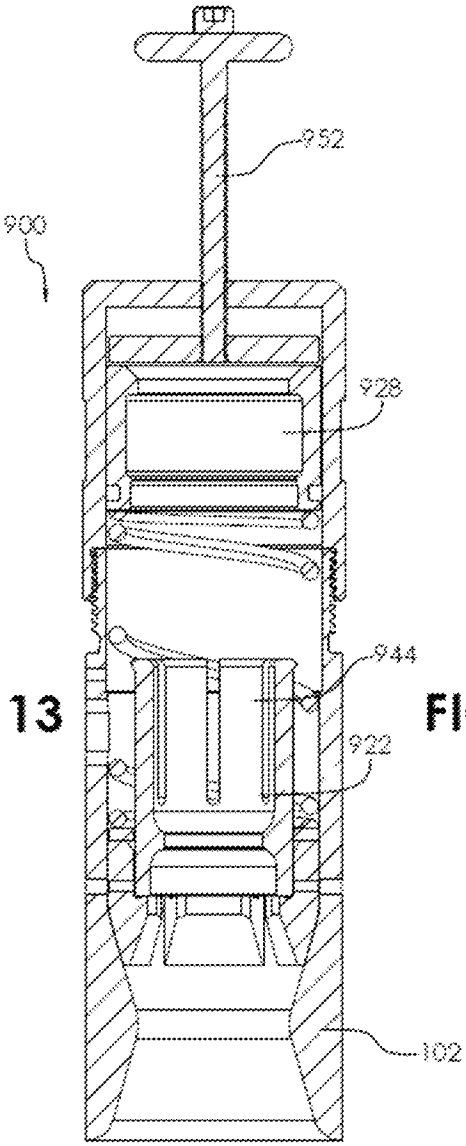
FIG. 13 is a sectional view of a portion of the wireline saver tool of FIG. 9 during assembly.

FIGS. 12-14 illustrate a non-limiting example of steps for assembling the tool 900 using a loading tool 952. In this example, the loading tool 952 is a plunger device; however, in other embodiments, other tools, mechanisms, or techniques may be used to assemble the tool 900. As such, the loading tool 952 should not be considered limiting.

Figure 15:
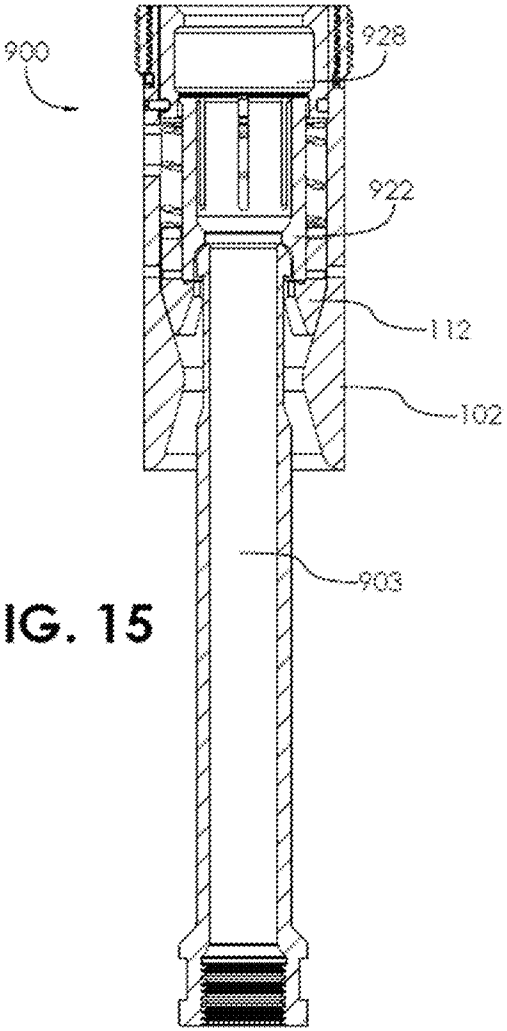
FIG. 15 is a sectional view of the wireline saver tool of FIG. 9 in a base configuration.

FIG. 15 illustrates the tool 900 in the normal or base configuration. As illustrated in FIG. 15, in the base configuration, the biasing member 126 may be retained in its compressed state, the support device 903 is at least partially positioned within the central aperture 108, and the plug 922 is engaged with the support device 103 within the central aperture 108. In addition, the plug 922 is engaged with the lower ledge 942, and optionally is engaged with the lower surface 948 of the lower ledge 942. In certain embodiments, the stoppers 112 are retained within the central aperture 108 (e.g., via the retaining mechanisms 120).

Figure 17:
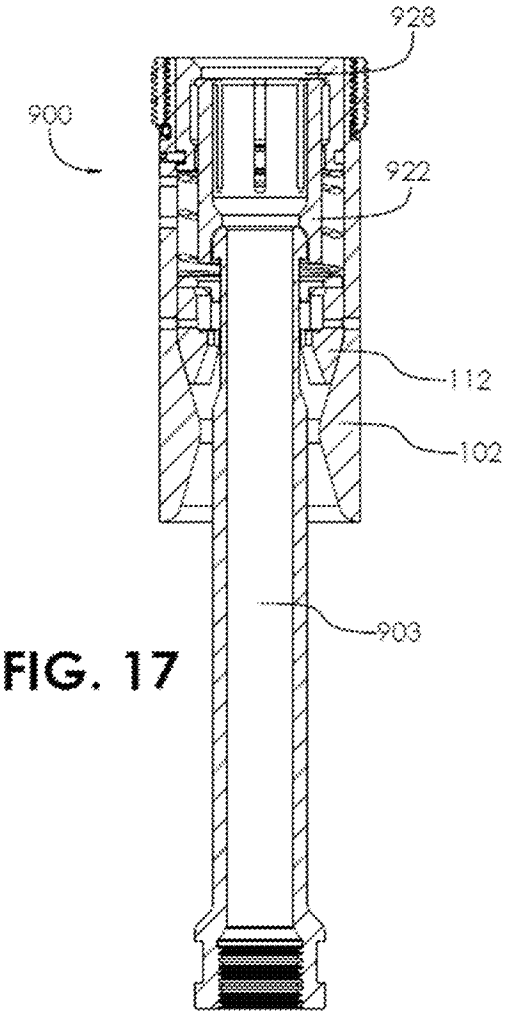
FIGS. 16-18 are sectional views of the wireline saver tool of FIG. 9 in an operating position responsive to an upwards force compared to FIG. 15.
Figure 16:
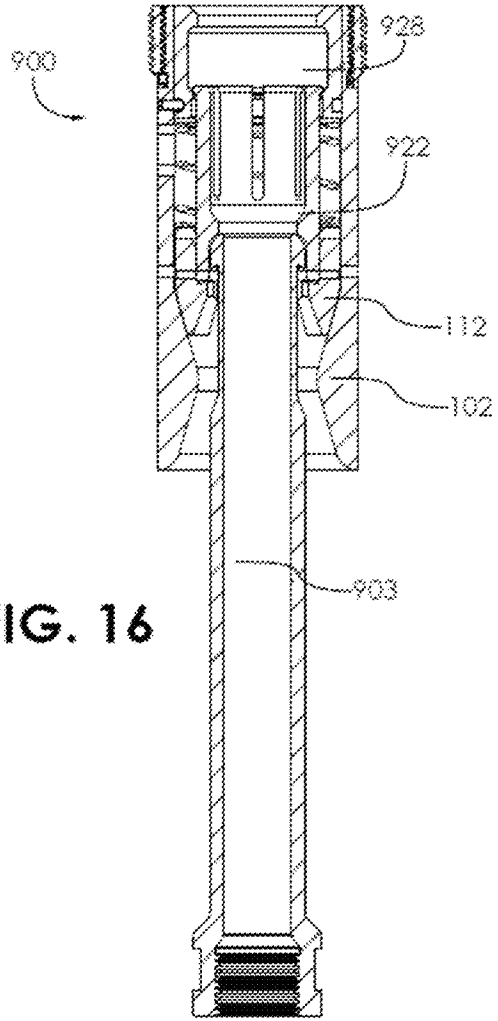
Figure 18:
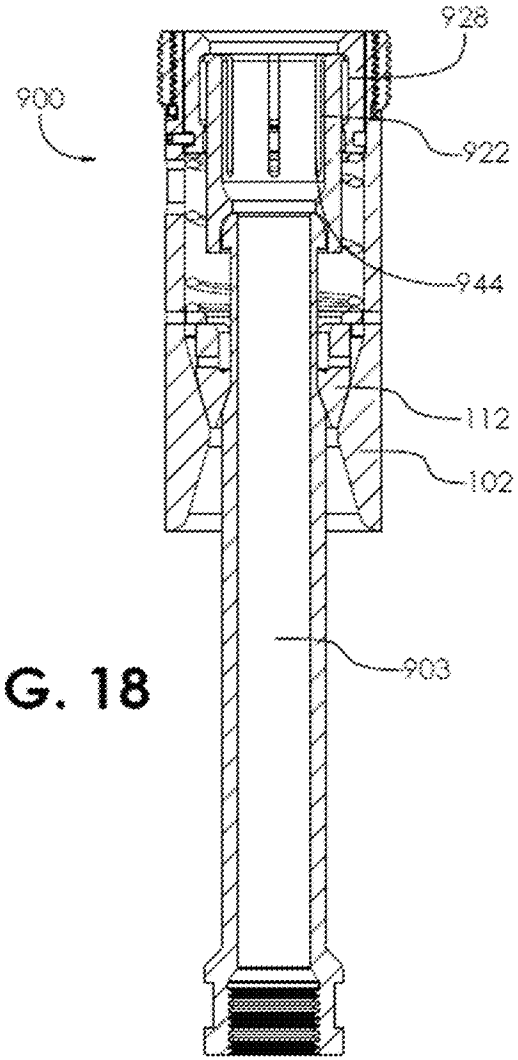

FIGS. 16-18 illustrate the tool 900 in intermediate configurations responsive to an activating event. In certain embodiments, the activating event may be, but does not have to be, an upward force being applied on the support device 903. In various embodiments, such a force may be greater than a predetermined threshold and/or may be a change in force greater than some predetermined threshold. In one non-limiting example, an activating event may be caused by operator error and/or equipment error such that the manipulation of the wireline tool string and the manipulation of the lubricator (connected to the tool 900) are desynchronized.

As illustrated in FIG. 16, such an activating event applies a force on the plug 922 such that the flex members 944 flex inwards, thereby allowing the plug 922 to move upwards past the lower ledge 942 (FIG. 16) and optionally into contact with the upper ledge 940 (FIGS. 17 and 18). As mentioned, contact between the upper ledge 940 and the plug 922 in the intermediate configurations may serve as a limit on the upward movement of the plug 922 and thus the support device 903 (in addition to or in place of contact between the neck of the housing and the support device 903).

Referring to FIG. 18, in various embodiments, the upward movement of the plug 922 caused by the activating event in turn may cause the plug 922 to no longer contact the insert 130, and the loss of contact with the plug 922 allows for the downward force from the biasing member 126 to overcome the support provided by the lower retaining mechanisms 120. In other words, the biasing member 126 may cause the lower retaining mechanisms 120 to fail and/or otherwise allow movement of the insert 130 and the stoppers 112 such that the stoppers 112 are pushed downwards and into their deployed position. As illustrated by comparing FIG. 15 with FIG. 18, in the deployed position, the stoppers 112 may further narrow the travel path for the support device 903. Optionally, the stoppers 112 may engage the support device 903 when deployed and in the intermediate configuration. In some optional embodiments, a curvature and/or profile of the neck 110 may facilitate movement of the stoppers 112 from the base position to the deployed position.

Figure 19:
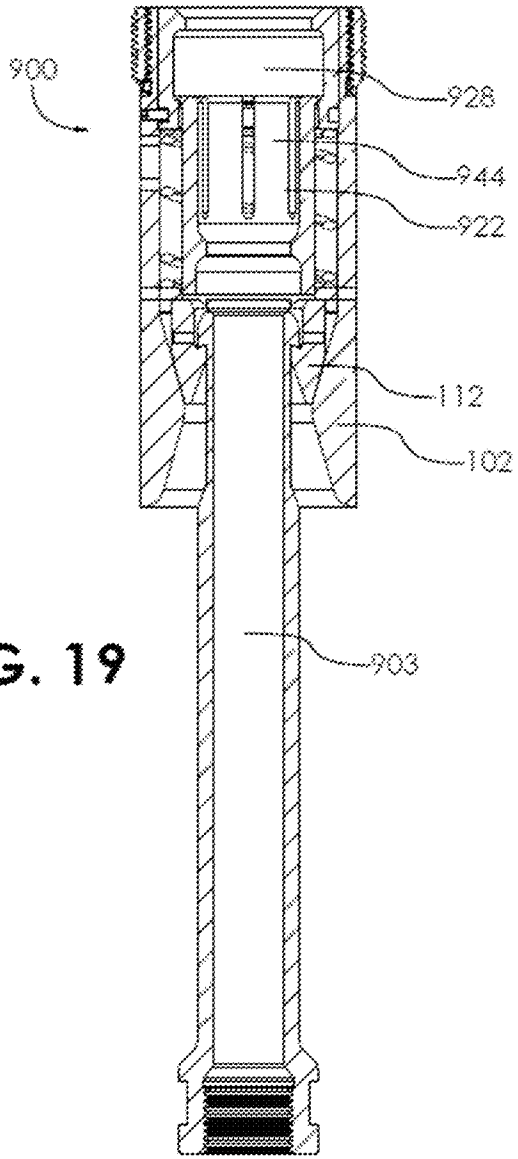
FIG. 19 is a sectional view of the wireline saver tool of FIG. 9 in an operating position in the absence of the upwards force in FIGS. 16-18.

FIG. 19 illustrates the tool 900 in a fully deployed configuration. The tool 900 may be in this configuration once the original activating event causing movement in FIG. 16 has ended and/or an upward force is no longer being applied on the support device 903. In some embodiments, in the fully deployed configuration, the lower ledge 942 of the support 928 may engage the plug 922 so as to catch the plug 922. Optionally, in the fully deployed configuration, the support 928 engages the upper surface 950 of the lower ledge 942. Catching the plug 922 with the lower ledge 942 may provide a clearance between the plug 922 and the support device 903, which may provide protection to the plug 922 and/or allow for the tool 900 to be reused.

As illustrated in FIG. 19, in the fully deployed configuration, the support device 903 (and any connected tool string) may fall downwards (e.g., due to gravity). However, the stoppers 112 in the deployed position are able to engage and catch the support device 903 to prevent the support device 903 from falling completely through housing 102. In this manner, the stoppers 112 may server as a limit on the downward movement of the support device 903 and/or a maximum downward position of the support device 903 relative to the tool 900 once the tool 900 is deployed, thereby providing improved safety to an environment in which the support device 103 is being used.

The aforementioned means for catching the support device 103 should not be considered limiting, and in other embodiments, other devices and/or mechanisms may be used to mechanically catch the support device 103 responsive to an activating event.

A collection of exemplary embodiments is provided below, including at least some explicitly enumerated as an "Illustration" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A wireline saver tool assembly comprising non-hydraulic means for automatically mechanically engaging a support device of a wireline tool string.

Illustration 2. The wireline saver tool assembly of any preceding or subsequent illustration or combination of illustrations, further comprising a housing comprising a first end and a second end, wherein the first end is couplable to a lubricator, and wherein the second end is configured to receive the support device.

Illustration 3. The wireline saver tool assembly of any preceding or subsequent illustration or combination of illustrations, wherein the non-hydraulic means comprise: a plug configured to engage the support device within the housing; an upper retaining mechanism positioning the plug within the housing; a biasing member within the housing; one or more stoppers within the housing; an insert within the housing and forming an interface between the biasing member and the one or more stoppers, wherein the plug contacts the insert within the housing, and wherein the contact between the plug and the insert positions the insert within the housing; and a lower retaining mechanism positioning the one or more stoppers within the housing.

Illustration 4. The wireline saver tool assembly of any preceding or subsequent illustration or combination of illustrations, wherein, responsive to an upward force at a predetermined threshold: the plug is moved upwards r past the upper retaining mechanism within the housing; upward movement of the plug causes the plug to lose contact with the insert; the lost contact between the plug and the insert allows a downward force from the biasing member on the insert causing the lower retaining mechanism to fail; and the one or more stoppers are moved downwards responsive to the failure of the lower retaining mechanism and the downward force from the biasing member.

Illustration 5. The wireline saver tool assembly of any preceding or subsequent illustration or combination of illustrations, wherein the housing comprises a neck within a central aperture defining a minimum dimension of the central aperture, wherein the neck is within the central aperture between the first end and the second end of the housing.

Illustration 6. The wireline saver tool assembly of any preceding or subsequent illustration or combination of illustrations, further comprising the support device couplable to a tool string, the support device comprising an outer surface and a lip extending outwards from the outer surface, wherein the non-hydraulic means are configured to mechanically engaging the outer surface and the lip of the support device within a housing.

Illustration 7. A wireline saver tool assembly comprising: a housing; and one or more stoppers within the housing, wherein the one or more stoppers are movable within the housing for selectively engaging a support device of a wireline tool string within the housing.

Illustration 8. The wireline saver tool assembly of any preceding or subsequent illustration or combination of illustrations, wherein the one or more stoppers are configured to narrow a travel path for the support device within the housing responsive to an activating event.

Illustration 9. The wireline saver tool assembly of any preceding or subsequent illustration or combination of illustrations, wherein the housing comprises a neck within a central aperture defining a minimum dimension of the central aperture of the housing, wherein the neck is within the central aperture between a first end and a second end of the housing, and wherein the one or more stoppers are configured to engage the support device at the neck of the housing.

Illustration 10. The wireline saver tool assembly of any preceding or subsequent illustration or combination of illustrations, further comprising a biasing mechanism within the housing, wherein the biasing mechanism is configured to move the one or more stoppers within the housing and to engage the support device responsive to an activating event.

Illustration 11. The wireline saver tool assembly of any preceding or subsequent illustration or combination of illustrations, further comprising: a support positioned within the housing; and a plug positioned within the housing and configured to engage the support device.

Illustration 12. The wireline saver tool assembly of any preceding or subsequent illustration or combination of illustrations, wherein the support defines a maximum upward position of the plug within the housing.

Illustration 13. The wireline saver tool assembly of any preceding or subsequent illustration or combination of illustrations, wherein the support comprises an upper ledge and a lower ledge, wherein: in a base configuration, the plug is engaged with a lower surface of the lower ledge; in an intermediate configuration, the plug is engaged with the upper ledge; and in a fully deployed configuration, the plug is engaged with an upper surface of the lower ledge.

Illustration 14. A wireline saver tool assembly comprising: a housing; a first movement limiting feature within the housing; and a second movement limiting feature within the housing, wherein the first movement limiting feature defines a maximum upward position of a support device of a wireline tool string within the housing, and wherein the second movement limiting feature defines a maximum downward position of the support device within the housing.

Illustration 15. The wireline saver tool assembly of any preceding or subsequent illustration or combination of illustrations, wherein the first movement limiting feature comprises a support positioned within the housing, wherein the wireline saver tool assembly further comprises a plug positioned within the housing and configured to engage the support device, wherein the support is configured to engage the plug at the maximum upward position.

Illustration 16. The wireline saver tool assembly of any preceding or subsequent illustration or combination of illustrations, wherein the second movement limiting feature comprises one or more stoppers within the housing, wherein the one or more stoppers are movable within the housing for selectively engaging the support device of a wireline tool string within the housing at least at the maximum downward position.

Illustration 17. The wireline saver tool assembly of any preceding or subsequent illustration or combination of illustrations, further comprising a biasing mechanism within the housing, wherein the biasing mechanism is configured to move the one or more stoppers within the housing and to engage the support device responsive to an activating event.

Illustration 18. The wireline saver tool assembly of any preceding or subsequent illustration or combination of illustrations, wherein the first movement limiting feature comprises a neck portion of the housing within a central aperture defining a minimum dimension of the central aperture of the housing.

Illustration 19. The wireline saver tool assembly of any preceding or subsequent illustration or combination of illustrations, further comprising the support device couplable to a tool string, the support device comprising an outer surface and a lip extending outwards from the outer surface, wherein the second movement limiting feature is configured to mechanically engage the outer surface and the lip of the support device within the housing.

Illustration 20. The wireline saver tool assembly of any preceding or subsequent illustration or combination of illustrations, further comprising: a plug configured to engage the support device within the housing; an upper retaining mechanism positioning the plug within the housing; a support within the housing; a biasing member within the housing; one or more stoppers within the housing, wherein the one or more stoppers are the second movement limiting feature; an insert within the housing and forming an interface between the biasing member and the one or more stoppers, wherein the plug contacts the insert within the housing, and wherein the contact between the plug and the insert positions the insert within the housing, and wherein the biasing member is between the support and the insert; and a lower retaining mechanism positioning the one or more stoppers within the housing, wherein at least one of the support or the housing are the first movement limiting feature.

Illustration 21. A wireline saver tool assembly comprising means for automatically mechanically engaging a support device of a wireline tool string.

Illustration 22. A wireline saver tool assembly comprising non-hydraulic means for mechanically engaging a support device of a wireline tool string.

Illustration 23. A wireline saver tool assembly comprising a housing and one or more stoppers within the housing, wherein the one or more stoppers are movable within the housing for selectively engaging a support device of a wireline tool string within the housing.

Illustration 24. A wireline saver tool assembly comprising a housing and one or more stoppers within the housing, wherein the one or more stoppers are configured to narrow a travel path for a support device of a wireline tool string within the housing responsive to an activating event.

Illustration 25. A wireline saver tool assembly comprising: a housing defining a central aperture through the housing, the housing comprising a neck within the central aperture defining a minimum dimension of the central aperture, wherein the neck is within the central aperture between a top end and a bottom end of the housing; and one or more stoppers within the central aperture and configured to engage a support device of a wireline tool string within the housing at the neck of the housing.

Illustration 26. A wireline saver tool assembly comprising a housing, a first movement limiting feature, and a second movement limiting feature, wherein the first movement limiting feature defines a maximum upward position of a support device of a wireline tool string within the housing, and wherein the second movement feature defines a maximum downward position of the support device within the housing.

Illustration 27. A wireline saver tool assembly comprising: a support device couplable to a tool string, the support device comprising an outer surface and a lip extending outwards from the outer surface; a housing; and means for mechanically engaging the outer surface and the lip of the support device within the housing.

Illustration 28. A wireline saver tool assembly comprising a housing, a biasing mechanism, and one or more stoppers within the housing, wherein the biasing mechanism is configured to move the one or more stoppers within the housing and to engage a support device of a wireline tool string within the housing responsive to an activating event.

Illustration 29. A wireline saver tool assembly comprising: a housing comprising a first end and a second end, wherein the first end is couplable to a lubricator, and wherein the second end is configured to receive a support device for a tool string; a plug configured to engage the support device within the housing; an upper retaining mechanism positioning the plug within the housing; a biasing member within the housing; one or more stoppers within the housing; an insert within the housing and forming an interface between the biasing member and the one or more stoppers, wherein the plug contacts the insert within the housing and the contact positions the insert within the housing; and a lower retaining mechanism positioning the one or more stoppers within the housing, wherein, responsive to an upward force at a predetermined threshold: the upper retaining mechanism fails such that the plug is moved upwards within the housing; upward movement of the plug causes the plug to lose contact with the insert; the lost contact between the plug and the insert allows a downward force from the biasing member on the insert causes the lower retaining mechanism to fail; and the one or more stoppers are moved downwards responsive to the failure of the lower retaining mechanism and the downward force from the biasing member.

The various aspects, embodiments, implementations or features of the described embodiments can be used separately or in any combination. In particular, it should be appreciated that the various elements of concepts from FIGS. 1-19 may be combined in various combinations, sub-combinations, and/or with additional features without departing from the spirit or scope of the invention.

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "vertical," "horizontal," "lateral," "longitudinal," "front," and "back," among others, are intended to refer to the orientation as illustrated and described in the figure (or figures) to which the components and directions are referencing.

The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention, and does not pose a limitation on the scope of the invention unless otherwise claimed. No language in the specification should be construed as indicating any non-claimed element as essential to the practice of the invention.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described embodiments, nor the claims that follow.

That which is claimed:

1. A wireline saver tool assembly comprising non-hydraulic means for automatically mechanically engaging a support device of a wireline tool string, further comprising a housing comprising a first end and a second end, wherein the first end is couplable to a lubricator, and wherein the second end is configured to receive the support device, wherein the non-hydraulic means comprise:

a plug configured to engage the support device within the housing;

an upper retaining mechanism positioning the plug within the housing;

a biasing member within the housing;

one or more stoppers within the housing;

an insert within the housing and forming an interface between the biasing member and the one or more stoppers, wherein the plug contacts the insert within the housing, and wherein the contact between the plug and the insert positions the insert within the housing; and a lower retaining mechanism positioning the one or more stoppers within the housing.

2. The wireline saver tool assembly of claim 1, wherein, responsive to an upward force at a predetermined threshold:

the plug is moved upwards past the upper retaining mechanism within the housing;

upward movement of the plug causes the plug to lose contact with the insert;

the lost contact between the plug and the insert allows a downward force from the biasing member on the insert causing the lower retaining mechanism to fail; and the one or more stoppers are moved downwards responsive to the failure of the lower retaining mechanism and the downward force from the biasing member.

3. The wireline saver tool assembly of claim 1, wherein the housing comprises a neck within a central aperture defining a minimum dimension of the central aperture, wherein the neck is within the central aperture between the first end and the second end of the housing.

4. The wireline saver tool assembly of claim 1, further comprising the support device couplable to a tool string, the support device comprising an outer surface and a lip extending outwards from the outer surface, wherein the non-hydraulic means are configured to mechanically engaging the outer surface and the lip of the support device within a housing.

5. A wireline saver tool assembly comprising:

a housing;

one or more stoppers within the housing, wherein the one or more stoppers are movable within the housing for selectively engaging a support device of a wireline tool string within the housing;

a support positioned within the housing; and a plug positioned within the housing and configured to engage the support device, wherein the support comprises an upper ledge and a lower ledge, wherein:

in a base configuration, the plug is engaged with a lower surface of the lower ledge;

in an intermediate configuration, the plug is engaged with the upper ledge; and in a fully deployed configuration, the plug is engaged with an upper surface of the lower ledge.

6. The wireline saver tool assembly of claim 5, wherein the one or more stoppers are configured to narrow a travel path for the support device within the housing responsive to an activating event.

7. The wireline saver tool assembly of claim 5, wherein the housing comprises a neck within a central aperture defining a minimum dimension of the central aperture of the housing, wherein the neck is within the central aperture between a first end and a second end of the housing, and wherein the one or more stoppers are configured to engage the support device at the neck of the housing.

8. The wireline saver tool assembly of claim 5, further comprising a biasing mechanism within the housing, wherein the biasing mechanism is configured to move the one or more stoppers within the housing and to engage the support device responsive to an activating event.

9. The wireline saver tool assembly of claim 5, wherein the support defines a maximum upward position of the plug within the housing.

10. A wireline saver tool assembly comprising:

a housing;

a first movement limiting feature within the housing;

a second movement limiting feature within the housing, wherein the first movement limiting feature defines a maximum upward position of a support device of a wireline tool string within the housing, and wherein the second movement limiting feature defines a maximum downward position of the support device within the housing;

a plug configured to engage the support device within the housing;

an upper retaining mechanism positioning the plug within the housing;

a support within the housing;

a biasing member within the housing;

one or more stoppers within the housing, wherein the one or more stoppers are the second movement limiting feature;

an insert within the housing and forming an interface between the biasing member and the one or more stoppers, wherein the plug contacts the insert within the housing, and wherein the contact between the plug and the insert positions the insert within the housing, and wherein the biasing member is between the support and the insert; and a lower retaining mechanism positioning the one or more stoppers within the housing, wherein at least one of the support or the housing are the first movement limiting feature.

11. The wireline saver tool assembly of claim 10, wherein the support is configured to engage the plug at the maximum upward position.

12. The wireline saver tool assembly of claim 10, wherein the one or more stoppers are movable within the housing for selectively engaging the support device of a wireline tool string within the housing at least at the maximum downward position.

13. The wireline saver tool assembly of claim 12, further comprising a biasing mechanism within the housing, wherein the biasing mechanism is configured to move the one or more stoppers within the housing and to engage the support device responsive to an activating event.

14. The wireline saver tool assembly of claim 10, wherein the first movement limiting feature comprises a neck portion of the housing within a central aperture defining a minimum dimension of the central aperture of the housing.

15. The wireline saver tool assembly of claim 10, further comprising the support device couplable to a tool string, the support device comprising an outer surface and a lip extending outwards from the outer surface, wherein the second movement limiting feature is configured to mechanically engage the outer surface and the lip of the support device within the housing.

* * * * *